United States Patent [19]

Bulso, Jr. et al.

[11] 4,331,017

[45] May 25, 1982

[54] HIGH REDUCTION PROCESS AND APPARATUS

[75] Inventors: Joseph D. Bulso, Jr.; William R. Lewers, both of Canton, Ohio

[73] Assignee: Joseph Bulso, Jr., Canton, Ohio

[21] Appl. No.: 215,527

[22] Filed: Dec. 11, 1980

[51] Int. Cl.[3] ..... B21D 22/00

[52] U.S. Cl. ..... 72/350; 72/347; 72/399; 72/457

[58] Field of Search ..... 72/347, 348, 349, 350, 72/399, 457

[56] References Cited

U.S. PATENT DOCUMENTS

| | | | |
|---|---|---|---|
| 3,147,723 | 9/1964 | Williamson | 72/350 X |
| 3,621,699 | 11/1971 | Valel et al. | 72/348 |
| 4,074,559 | 2/1978 | Beane | 29/159 R |
| 4,193,285 | 3/1980 | Zumsteg | 72/348 |

*Primary Examiner*—Leon Gilden

*Attorney, Agent, or Firm*—Reese Taylor

[57] ABSTRACT

A method for the high reduction of metal during a forming operation includes placing the metal blank being formed under compression by applying pressure to its peripheral edge surfaces and simultaneously engaging it with a drawing horn. The apparatus employed in the method includes a draw pad and a draw horn carried by the movable member or platen of a press and a die carried by the base of the press with the platen being movable toward and away from the base. The base also carries a matrix which carries a plurality of iris plates which are arranged in a circular fashion around a central axis of the die and which are adapted to move toward and away from the vertical center axis of the die so as to be moved into engagement with the peripheral edge surfaces of the blank as the press is brought to a closed position and the draw horn engages the blank. In this fashion, the blank is placed under radial compression simultaneously with being subjected to forming pressure by the draw horn to facilitate an extremely high percentage reduction of the metal.

7 Claims, 3 Drawing Figures

HIGH REDUCTION PROCESS AND APPARATUS

FIELD OF THE INVENTION

This invention relates, in general, to the art of metal forming and relates in particular to a method and apparatus for an extremely high percentage reduction of metal during a metal forming operation.

DESCRIPTION OF THE PRIOR ART

Traditionally, metal has been formed for a variety of purposes and in a variety of methods. Some of these methods include drawing, drawing and redrawing, ironing and spin forming.

It has also been theoretically contemplated that metal can be deformed by a combination of drawing with a draw horn and simultaneously applying side or lateral pressure to the workpiece so as to increase the percentage of reduction.

In a high reduction drawing process, which essentially involves reducing the diameter of the metal, under normal circumstances approximately 50 percent reduction is the maximum possible in one operation due to the fact that if a greater reduction is attempted, the metal simply will shear off. Thus, as the draw horn forms the metal it naturally tends to pull the metal toward the horn and if too great a reduction is attempted, the horn will simply shear or pass right through the metal, tearing it. This occurs when the strength of the metal in the flat area exceeds the strength of the metal in the forming area.

The theoretical approach referred to above, wherein pressure is applied to the periphery of the metal being formed, essentially involved the application of fluid pressure. This, however, required that the entire forming apparatus be contained in some sort of fluid-tight chamber, which is simply not a practicable solution on a production level.

Nevertheless, it is believed that a proper apparatus and method for applying radially or laterally directed pressure to the periphery of the workpiece during the drawing or forming operation is a desirable objective because, if it can be accomplished, reduction of up to 90 percent can be achieved without destroying the workpiece and with a significant increase in efficiency due to reduction of the number of operations required to progress from the workpiece to the finished product. This is essentially an attempt to alter the point at which the strength of the metal in the flat area exceeds the strength in the forming area to increase the amount of reduction possible without destruction of the workpiece.

BRIEF SUMMARY OF THE INVENTION

It has, therefore, now been found that substantially increased reduction can be accomplished without damage to the workpiece and with elimination of the normally required plurality of steps to achieve such high reduction.

It has been discovered that apparatus can be provided wherein pressure can be applied to the periphery of the plate simultaneously with the forming pressure applied by the draw horn to the surface of the plate by an apparatus which can be described as being an iris and which is either hydraulically or pneumatically actuated.

It has been discovered that this iris can be constructed of a plurality of circumferentially arranged iris plates carried by a matrix and each secured to an actuating member such as a hydraulic or pneumatic pressure system so that as the draw horn is forced against one face of the plate, the iris plates on the matrix can be forced against the peripheral edge of the plate, thereby placing the metal under compression and assisting in deforming the metal and reducing the diameter thereof. Essentially, the draw horn directs the metal in the proper direction and the iris plates assist it in flowing in that direction. As noted above, the draw horn itself creates a flow of the metal, however, the improved apparatus reduces the resistance to flow by forcing the metal in the direction of the flow and thus and avoids the problems normally encountered wherein the metal itself is essentially destroyed if too great a percentage of reduction is attempted at one time.

It has been found that this unique method of metal forming, together with the apparatus which facilitates it will enable metal to be formed much more efficiently with a significant reduction in a number of manufacturing operations required.

Accordingly, production of improved high reduction method and apparatus of the character above-described becomes the principal object of this invention, with other objects thereof becoming more apparent upon a reading of the following brief specification considered and interpreted in view of the accompanying drawings.

OF THE DRAWINGS

BRIEF DESCRIPTION OF THE PREFERRED EMBODIMENTS

Figure 1:
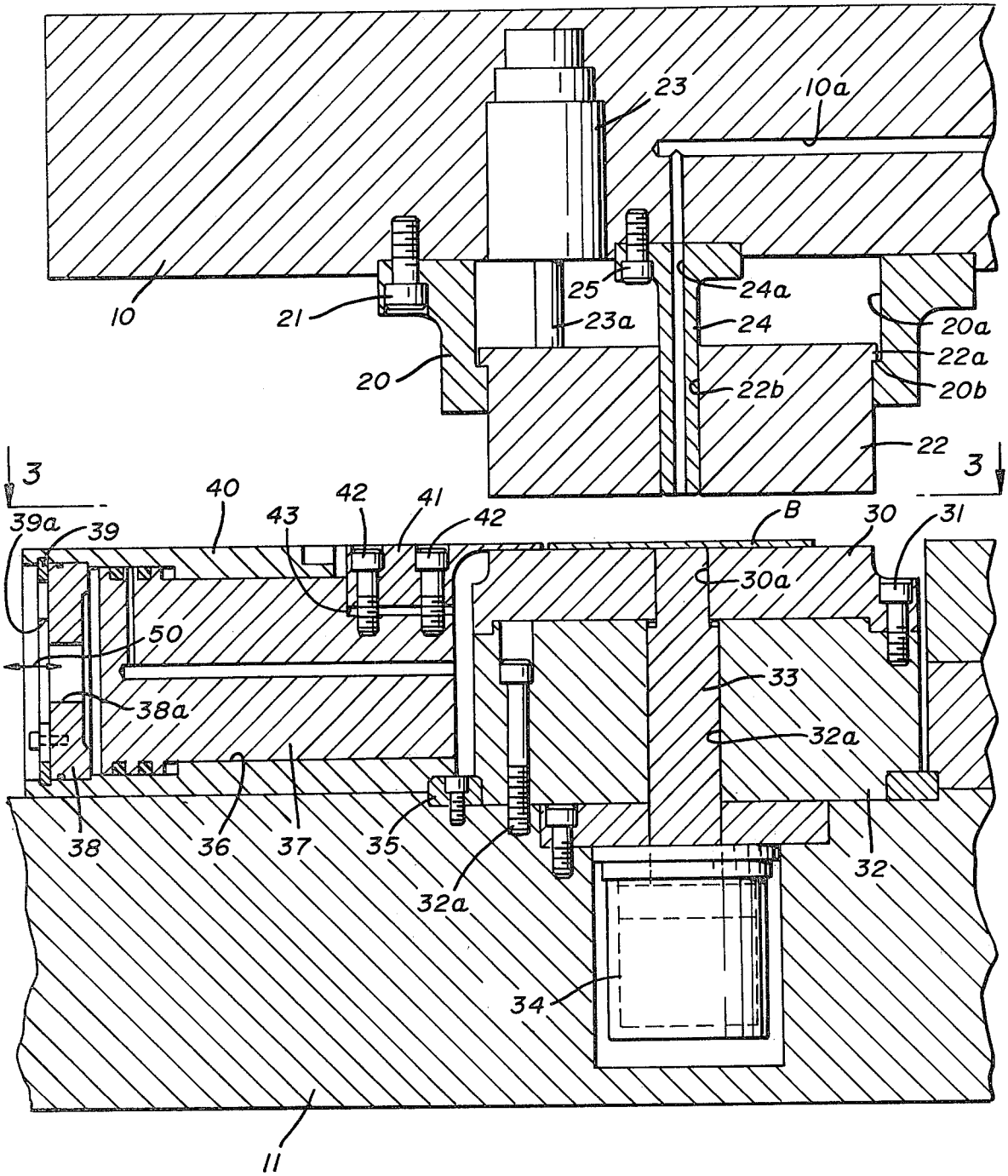
FIG. 1 is a partial, elevational view in section showing the apparatus necessary to carry out the method of the invention with the press in the open position.

Turning first to the apparatus involved in the present invention and referring to FIG. 1 of the drawings, it will be noted that this apparatus is intended to be utilized in a press which generally includes a movable platen 10 and a fixed base 11. The press structure and its actuating mechanism itself has not been described herein in any great detail, since utilization of any commercially available press having a fixed base and a platen movable toward and away from that base is believed to be well within the knowledge of one of ordinary skill in this art.

Still referring to FIG. 1, it will be noted that the movable platen 10 carries on it a draw pad retainer 20. This retainer is secured to the bottom surface of the platen 10 by a plurality of bolts 21, only one of which is illustrated. This retainer 20 is an annular member having an interior cavity **20*a* within which is received a draw pad 22. The draw pad 22 is of such size that it is capable of movement within the cavity 20*a* and has a lip 22*a* which normally rests on shoulder 20*b* of the retainer 20. The draw pad 22 also has a through central bore 22*b*** for purposes which will be described.

Also carried by the platen 10 is an actuating cylinder 23 for the draw pad 22. Only one of these cylinders is illustrated although in practice a plurality may be employed. In any event, the purpose of the cylinder 23 is to actuate the draw pad 22 so that it can move relatively of the platen in a downward direction, as will be described. Engagement of shoulder **20*b* and lip 22*a*** will insure that the draw pad moves together with the platen when the platen is moving in an upward direction, as will also be described.

Also secured to the bottom of the movable platen 10 is a draw horn 24, which has a central bore 24*a* and which is secured to the platen 10 by the bolts 25, a plurality of which will normally be employed but only one of which is illustrated. Platen 10 also has a through passage 10*a* which is in communication with passageway 24*a* for venting purposes. The draw horn 24, as noted, will move with the platen 10 both during its downward and upward periods of travel. The draw horn 24 also passes through the central bore 22*b* of the draw pad 22 so that it can properly co-act with the die, which will be described below.

Turning then to the fixed base 11, it will be noted that a die 30 having a central aperture 30*a* is secured by means of a plurality of bolts 31 to the die riser 32.

Die riser 32 has a central passageway 32*a*, which receives a lift out member 33 which is slidingly received therein and piston actuated. This member 33 is under pressure and is normally urged upward to the position shown in FIG. 1.

An actuating cylinder 34 is carried by the base 11 and carries the piston which urges the liftout member 33 in an axial direction to dislodge or lift out the finished product, as will be described.

It should also be noted that the die riser 32 is secured to the base by a plurality of bolts 32*a*.

Also secured to base 11 is a locating ring 35, which is an annular member secured to the top surface of the base 11 and which serves to properly locate the die riser 32 and matrix 40 which will, of course, then insure that the die 30 is also properly located and aligned with draw horn 24 and secured to the base 11.

A reciprocal piston 37 is received within matrix 40 in sliding contact with cylinder sidewall 36, as illustrated in FIG. 1. In actual practice a plurality of these pistons will be employed with the exact number not being necessarily critical to the invention being described herein. Only one piston-matrix assembly will be described in detail with it being understood that the other would be identical in construction and operation.

The piston 37 is retained within the matrix 40 by an end cap 38 and a keeper plate 39. Both the end cap 38 and the keeper plate 39 have through central apertures 38*a*, 39*a*, which are in fluid communication with either a hydraulic or pneumatic pressure system (not shown) so as to be capable of selectively moving the piston 37 to the right or left of the FIG. 1 in the directions indicated by the arrow 50. This pressure system is not illustrated in detail since a system which permits reciprocation of piston 37 as indicated by arrow 50, in timed relationship with the movement of platen 10, is believed to be within the skill of one knowledgeable in this art.

Figure 2:
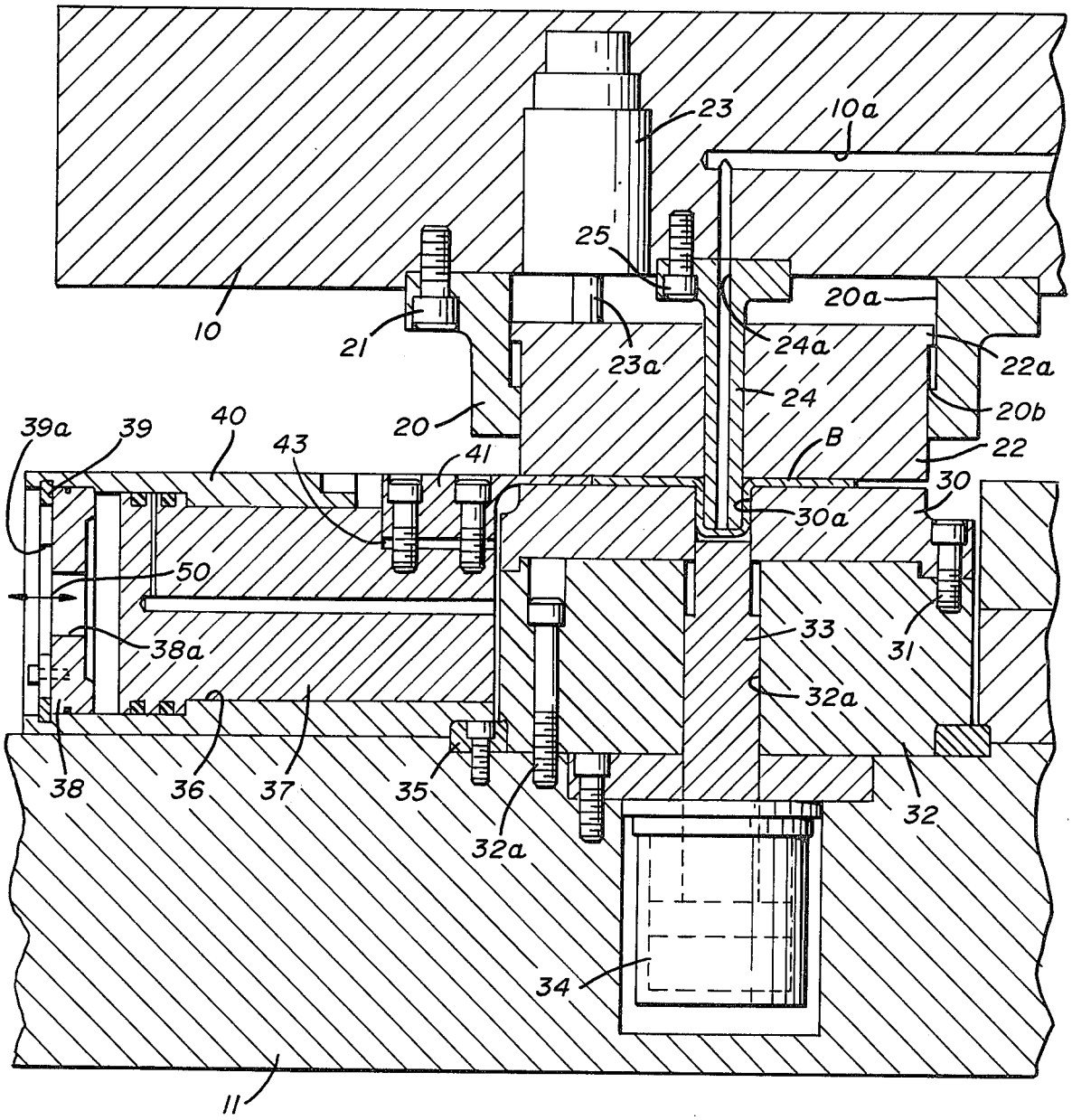
FIG. 2 is a view similar to FIG. 1 with the press in the closed position.
Figure 3:
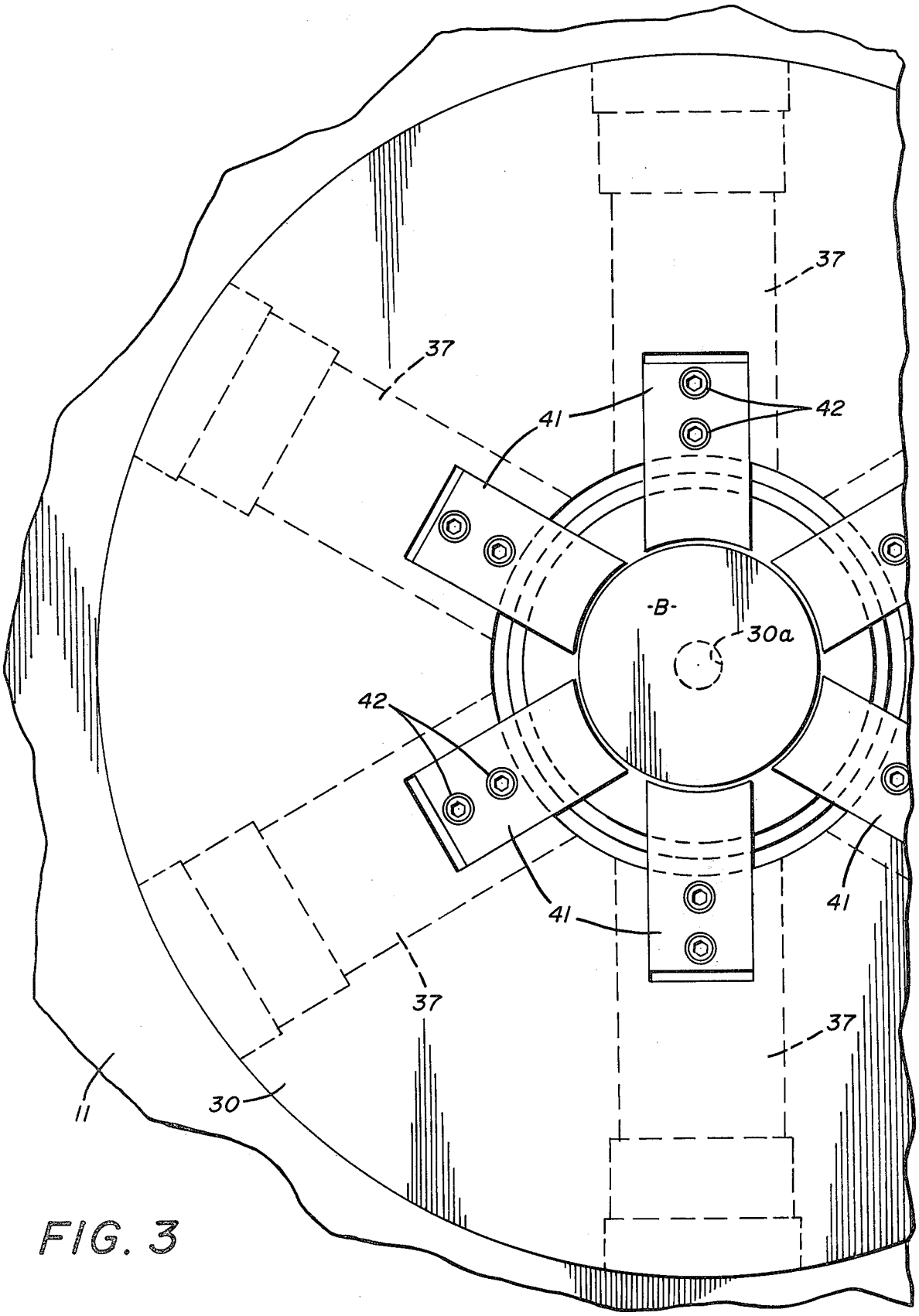
FIG. 3 is a partial plan view, taken along the line 3—3 of FIG. 1.

Referring to FIGS. 1 and 2, the matrix 40 carries a plurality of iris plates 41. Again, the exact number is not critical to this invention, although six are illustrated in FIG. 3. Suffice it to say that they are all identical and each will be associated with a piston 37.

Still referring to FIGS. 1 and 2 where one of the iris plate assemblies is illustrated, it will be noted that the plate 41 and the spacer 43 are secured to the piston 37 by the bolts 42,42. In this fashion as each piston 37 is moved in the direction of the arrow 50, its associated iris plate will, of course, move with it toward the central axis of the die.

In use or operation of the invention, reference is first made to FIG. 1 of the drawings where the press is shown in an open position. It will be seen that a flat workpiece B will first be placed on the top surface of the die 30 and concentrically aligned therewith. At that time, the iris plates will be in a retracted position so that, for example, the piston 37 and the iris plate 41 will be retracted to the far left hand position of FIG. 1. Lift out member 33, which is normally urged upwardly, will be in its extended position as shown.

Turning to FIG. 2 it will be noted that, upon actuation of the press, the movable platen 10 will move toward the die 30. Hold down or clamping pressure will be achieved by means of cylinder 23 and stem 23*a* acting on the draw pad 22, which will be forced down and into contact with the upper surface of the workpiece B. Further downward movement of the platen will bring the draw horn 24 into contact with the workpiece B and simultaneously therewith the pistons 37 will be actuated so as to close the iris plates or reduce their effective diameter by forcing each iris plate 41 toward the central axis of the die until it contacts the edge surfaces of the workpiece B. Further downward movement of the movable platen 10 will force the draw horn into the workpiece B forming it and forcing lift out member 33 down, while simultaneous pressure is applied to the periphery of the workpiece by the plates 41 so as to place the piece under compression. In this fashion, the forming force of the draw horn is assisted by the compression forces of the iris plates 41 of the matrix 40 to assist the metal flow and an extremely high percentage of reduction is made possible without destruction of the workpiece.

This phenomenon can be explained by considering that the strength of the metal can be expressed as circumference X and diameter X tensile strength. Thus, a particular piece of metal has a given resistance to being forced into the aperture 30*a* of die 30. As the draw horn 24 forces the metal into the aperture 30*a*, the strength of the metal in the forming area lessens and relative to the strength in that area and this difference ultimately leads to destruction of the workpiece. The action of the iris plates 41, however, urges the metal into the forming area and delays the time at which such destruction will occur, thus enabling much greater reduction than has heretofore been possible.

Following forming the workpiece B can then be removed as the press opens; the plates 41 retract; and holddown pressure is released by engagement of shoulder 20*b* and lip 22*a* to lift the pad 22 away from the workpiece. Lift out member 33 will then return to its extended position to dislodge the workpiece from die 30. Also, while communicating passageways 24*a* in the draw horn 24 and 10*a* in platen 10 are normally used for venting purposes, they could be selectively connected to a source of pneumatic pressure for "blow off" purposes if desired.

While a full and complete description of the invention has been set forth in accordance with the dictates of the Patent Statutes, it should be understood that modifications can be resorted to without departing from the spirit hereof or the scope of the appended claims.

For example, six pressure plates are illustrated. The exact number can vary primarily depending on the size of the workpiece.

What is claimed is:

1. A method for high reduction metal forming comprising the steps of:

(A) clamping a blank of material between movable and fixed members of a press;

(B) forcing a forming horn against one face of said material and into a female die; and (C) simultaneously applying radially inwardly directed pressure against the edge surfaces of said blank of material (1) whereby compressive force is applied to the periphery of said blank.

2. The method of claim 1 wherein Step C is accomplished by moving a plurality of circumferentially disposed plates inwardly toward the center of said blank.

3. Apparatus for high reduction of a metal blank for use in a press having a base and a relatively movable platen, comprising;

(A) a draw horn carried by the movable platen;

(B) a draw pad carried by the movable platen and movable relatively of said draw horn toward the base;

(C) a die carried by the base of the press for receipt of the blank;

(D) said draw horn being movable into and out of forming engagement with the blank; and (E) pressure means carried by the base of the press and being collapsible toward and away from the central axis of the die simultaneously with movement of said draw horn into and out of engagement with the blank.

4. The apparatus of claim 3 wherein said pressure means includes (A) a plurality of iris plates arranged in a circular pattern when viewed in plan; and (B) said iris plates being movable toward and away from the central axis of said die.

5. The apparatus of claim 3 wherein liftout means are carried by the base of the press and are movable toward and away from the movable platen.

6. Apparatus for high reduction of a metal blank for use in a press having a base and a relatively movable platen, comprising:

(A) a draw horn carried by the movable platen;

(B) a draw pad retainer carried by the movable platen;

(C) a draw pad carried within said draw pad retainer and being movable relatively thereof into and out of holding contact with the blank;

(D) a die carried by the base of the press;

(E) said draw horn being movable into and out of forming engagement with the blank;

(F) pressure means carried by the base of the press and being movable toward and away from the central axis of said die and into and out of contact with the periphery of the blank simultaneously with movement of said draw horn into and out of engagement with the blank; and (G) lift out means carried by the base of the press and being movable toward and away from the movable platen.

7. The apparatus of claim 6 wherein said pressure means includes (A) a plurality of iris plates arranged in a circular pattern when viewed in plan; and (B) said iris plates being movable toward and away from the central axis of said die.

* * * * *